US009215542B2

(12) United States Patent
Silzle et al.

(10) Patent No.: US 9,215,542 B2
(45) Date of Patent: Dec. 15, 2015

(54) APPARATUS AND METHOD FOR MEASURING A PLURALITY OF LOUDSPEAKERS AND MICROPHONE ARRAY

(71) Applicant: Fraunhofer-Gesellschaft zur Foerderung der angewandten Forschung e.V., Munich (DE)

(72) Inventors: Andreas Silzle, Buckendorf (DE); Oliver Thiergart, Forchheim (DE); Giovanni Del Galdo, Martinroda (DE); Matthias Lang, Berching (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 463 days.

(21) Appl. No.: 13/629,088

(22) Filed: Sep. 27, 2012

(65) Prior Publication Data

US 2013/0058492 A1 Mar. 7, 2013

Related U.S. Application Data

(63) Continuation of application No. PCT/EP2011/054877, filed on Mar. 30, 2011.

(60) Provisional application No. 61/319,712, filed on Mar. 31, 2010.

(30) Foreign Application Priority Data

Apr. 14, 2010 (EP) ..... 10159914

(51) Int. Cl.
*H04R 29/00* (2006.01)
*H04R 5/027* (2006.01)
(Continued)

(52) U.S. Cl.
CPC ..... *H04R 29/002* (2013.01); *H04R 5/027* (2013.01); *H04R 1/406* (2013.01);
(Continued)

(58) Field of Classification Search
CPC .... H04R 29/00; H04R 29/001; H04R 29/005; H04R 29/004; H04R 3/005; H04R 1/406
USPC ..... 381/58–59, 103, 300, 303, 307, 92
See application file for complete search history.

(56) References Cited

U.S. PATENT DOCUMENTS 8,130,967 B2 * 3/2012 Kino ..... 381/59
8,406,436 B2 * 3/2013 Craven et al. ..... 381/170
(Continued)

FOREIGN PATENT DOCUMENTS

CN 101263743 9/2008
EP 0869697 10/1996
(Continued)

OTHER PUBLICATIONS

ITU-R Recommendation-BS. "Methods for the Subjective Assessment of Small Impairments in Audio Systems Including Multichannel Sound Systems", 1116-1. Intern. Telecom Union. Geneva, Switzerland., 1997, 26 Pages.
(Continued)

*Primary Examiner* — Disler Paul
(74) *Attorney, Agent, or Firm* — Michael A. Glenn; Perkins Coie LLP

(57) ABSTRACT

An apparatus for measuring a plurality of loudspeakers arranged at different positions includes a generator of a test signal for a loudspeaker; a microphone device configured for receiving a plurality of different sound signals in response to one or more loudspeaker signals emitted by one of the loudspeakers in response to the test signal; a controller for controlling emissions of the loudspeaker signals by the loudspeakers and for handling the different sound signals so that a set of sound signals recorded by the microphone device is associated with each loudspeaker in response to the test signal; and an evaluator for evaluating the set of sound signals for each loudspeaker to determine at least one loudspeaker characteristic for each loudspeaker and for indicating a loudspeaker state using the at least one loudspeaker characteristic. This scheme allows automatic, efficient and accurate measurement of loudspeakers arranged in a three-dimensional configuration.

14 Claims, 12 Drawing Sheets

(51) Int. Cl.
*H04R 1/40* (2006.01)
*H04S 7/00* (2006.01)

(52) U.S. Cl.
CPC ..... *H04R 2201/401* (2013.01); *H04S 7/301* (2013.01); *H04S 2400/03* (2013.01); *H04S 2400/15* (2013.01); *H04S 2420/03* (2013.01)

(56) References Cited

U.S. PATENT DOCUMENTS

| | | | | |
|---|---|---|---|---|
| 2007/0086595 | A1* | 4/2007 | Asada | 381/59 |
| 2007/0110251 | A1* | 5/2007 | Krantz et al. | 381/58 |
| 2007/0263889 | A1* | 11/2007 | Melanson | 381/300 |
| 2008/0170718 | A1* | 7/2008 | Faller | 381/92 |
| 2008/0232616 | A1* | 9/2008 | Pulkki et al. | 381/300 |
| 2009/0316923 | A1* | 12/2009 | Tashev et al. | 381/66 |

FOREIGN PATENT DOCUMENTS

| | | |
|---|---|---|
| EP | 1286175 | 2/2003 |
| EP | 1544635 | 6/2005 |
| EP | 1933596 | 7/2008 |
| EP | 1983799 | 10/2008 |
| JP | H07218614 | 8/1995 |
| JP | 20010-25085 | 1/2001 |
| JP | 2006-211047 | 8/2006 |
| JP | 2007-068021 | 3/2007 |
| WO | WO-2009077152 | 6/2009 |

OTHER PUBLICATIONS

Ahonen, J et al., "Teleconference Application and B-Format Microphone Array for Directional Audio Coding", Presented at the AES 30th International Conference: Intelligent Audio Environments. Saariselka, Finland. Mar. 15-17, 2007, 1-10.

Del Gado, G et al., "Nested Microphone Array Processing for Parameter Estimation in Directional Audio Coding", Proceedings of IEEE Workshop on Applications of Signal Processing to Audio and Acoustics (WASPAA), New Paltz, NY. Oct. 18-21, 2009, 4 Pages.

Kallinger, M et al., "Analysis and Adjustment of Planar Microphone Arrays for Application in Directional Audio Coding", Presented at the AES 124th Convention, Amsterdam, The Netherlands. May 17-20, 2008, 12 Pages.

Merimaa, J et al., "Measurement, Analysis, and Visualization of Directional Room Responses", Presented at the AES 111th Convention, New York, NY, USA. Sep. 21-24, 2001, 9 Pages.

Muller, S et al., "Transfer-Function Measurement With Sweeps", J. Audio Eng. Soc. vol. 49, No. 6., Jun. 2001, 443-471.

Pulkki, V. et al., "Spatial Sound Reproduction With Directional Audio Coding", Journal of the AES. vol. 55, No. 6., Jun. 2007, 503-516.

Schultz-Amling, R et al., "Planar Microphone Array Processing for the Analysis and Reproduction of Spatial Audio Using Directional Audio Coding", Presented at the 124th AES Convention, Amsterdam, The Netherlands. May 17-20, 2008, 10 Pages.

Silzle, A et al., "Vision and Technique behind the New Studios and Listening Rooms of the Fraunhofer IIS Audio Laboratory", Presented at the AES 126th Convention. Munich, Germany., 1997, 15 Pages.

Thiergart, O et al., "Localization of Sound Sources in Reverberant Environments Based on Directional Audio Coding Parameters", Presented at the AES 127th Convention. New York, NY, USA. Oct. 9-12, 2009, 14 Pages.

* cited by examiner $$U_x(k, n) = B(k,d)(P_1(k,n) - P_3(k,n)),$$
$$U_y(k, n) = B(k.d)(P_2(k,n) - P_4(k,n)),$$
$$U_z(k, n) = B(k,d)(P_5(k,n) - P_6(k,n)),$$

$$P(k,n) = \sum_i P_i(k,n).$$

Observed spatial power densiny (Γ) of
a loudspeaker placed in [φ, θ] = [0°, 0°]

Iouspeaker characteristic's:

- $h(t) = \mathrm{IFFT}(H(f))$
- $|H(f)| = 20 \log |H(f)|$ dB
- $\varphi(f) = \mathrm{arcfan} \frac{\mathrm{Im}(H(f))}{\mathrm{Rc}(H(f))}$
- $\tau = -\frac{1}{2\pi} \cdot \frac{\partial \varphi}{\partial f}$
- $ETC' = 20 \log (h^2(t))$ dB
- $d = v \cdot t$
- DOA using DIRAC algorithm

| | |
|---|---|
| distance: | first length of impulse response until (including) maximum |
| DOA: | seconde length of impulse response until (not including) early reflections |
| loudspeaker impulse response / transferfunktion: | third length of impulse response including early reflections and diffuse reflections |

APPARATUS AND METHOD FOR MEASURING A PLURALITY OF LOUDSPEAKERS AND MICROPHONE ARRAY

CROSS-REFERENCE TO RELATED APPLICATIONS

This application is a continuation of copending International Application No. PCT/EP2011/054877, filed Mar. 30, 2011, which is incorporated herein by reference in its entirety, and additionally claims priority from U.S. Patent Application No. 61/319,712, filed Mar. 31, 2010, and European Patent Application EP 10159914.0, filed Apr. 14, 2010, both of which are incorporated herein by reference in their entirety.

The present invention relates to acoustic measurements for loudspeakers arranged at different positions in a listening area and, particularly, to an efficient measurement of a high number of loudspeakers arranged in a three-dimensional configuration in the listening area.

BACKGROUND OF THE INVENTION

FIG. 2 illustrates a listening room at Fraunhofer IIS in Erlangen, Germany. This listening room may be used for performing listening tests. These listening tests may be used for evaluating audio coding schemes. In order to ensure comparable and reproducible results of the listening tests, these tests may be performed in standardized listening rooms, such as the listening room illustrated in FIG. 2. This listening room follows the recommendation ITU-R BS 1116-1. In this room, the large number of 54 loudspeakers is mounted as a three-dimensional loudspeaker set-up. The loudspeakers are mounted on a two-layered circular truss suspended from the ceiling and on a rail system on the wall. The large number of loudspeakers provides great flexibility, which is useful, both for academic research and to study current and future sound formats.

With such a large number of loudspeakers, verifying that they are working correctly and that they are properly connected is a tedious and cumbersome task. Typically, each loudspeaker has individual settings at the loudspeaker box. Additionally, an audio matrix exists, which allows switching certain audio signals to certain loudspeakers. In addition, it cannot be guaranteed that all loudspeakers, apart from the speakers, which are fixedly attached to a certain support, are at their correct positions. In particular, the loudspeakers standing on the floor in FIG. 2 can be shifted back and forth and to the left and right and, therefore, it cannot be guaranteed that, at the beginning of a listening test, all speakers are at the position at which they should be, all speakers have their individual settings as they should have and that the audio matrix is set to a certain state in order to correctly distribute loudspeaker signals to the loudspeakers. Apart from the fact that such listening rooms are used by a plurality of research groups, electrical and mechanical failures can occur from time to time.

In particular, the following exemplary problems can occur. These are:

- Loudspeakers not switched on or not connected
- Signal routed to the wrong loudspeaker, signal cable connected to the wrong loudspeaker
- Level of one loudspeaker wrongly adjusted in the audio routing system or at the loudspeaker
- Wrongly set equalizer in the audio routing system or at the loudspeaker
- Damage of a single driver in a multi-way loudspeaker
- Loudspeaker is wrongly placed, oriented or an object is obstructing the acoustic pathway.

Normally, in order to manually evaluate the functionality of the loudspeaker set-up in the listening area, a great amount of time is involved. This time may be used for manually verifying the position and orientation of each loudspeaker. Additionally, each loudspeaker has to be manually inspected in order to find out the correct loudspeaker settings. In order to verify the electrical functionality of the signal routing on the one hand and the individual speakers on the other hand, a highly experienced person may perform a listening test where, typically, each loudspeaker is excited with the test signal and the experienced listener then evaluates, based on his knowledge, whether this loudspeaker is correct or not.

It is clear that this procedure is expensive due to the fact that a person performing it may be highly experienced. Additionally, this procedure is tedious due to the fact that the inspection of all loudspeakers will typically reveal that most, or even all, loudspeakers are correctly oriented and correctly set, but on the other hand, one cannot dispense with this procedure, since a single or several faults, which are not discovered, can destroy the significance of a listening test. Finally, even though an experienced person conducts the functionality analysis of the listening room, errors are, nevertheless, not excluded.

SUMMARY

According to an embodiment, an apparatus for measuring a plurality of loudspeakers arranged at different positions may have: a test signal generator for generating a test signal for a loudspeaker; a microphone device being configured for receiving a plurality of different sound signals in response to one or more loudspeaker signals emitted by a loudspeaker of the plurality of loudspeakers in response to the test signal; a controller for controlling emissions of the loudspeaker signals by the plurality of loudspeakers and for handling the plurality of different sound signals so that a set of sound signals recorded by the microphone device is associated with each loudspeaker of the plurality of loudspeakers in response to the test signal; and an evaluator for evaluating the set of sound signals for each loudspeaker to determine at least one loudspeaker characteristic for each loudspeaker and for indicating a loudspeaker state using the at least one loudspeaker characteristic for the loudspeaker.

According to another embodiment, a method of measuring a plurality of loudspeakers arranged at different positions in a listening space may have the steps of: generating a test signal for a loudspeaker; receiving a plurality of different sound signals by a microphone device in response to one or more loudspeaker signals emitted by a loudspeaker of the plurality of loudspeakers in response to the test signal; controlling emissions of the loudspeaker signals by the plurality of loudspeakers and handling the plurality of different sound signals so that a set of sound signals recorded by the microphone device is associated with each loudspeaker of the plurality of loudspeakers in response to the test signal; and evaluating the set of sound signals for each loudspeaker to determine at least one loudspeaker characteristic for each loudspeaker and indicating a loudspeaker state using the at least one loudspeaker characteristic for the loudspeaker.

Another embodiment may have a computer program for performing a computer program implementing the method of measuring a plurality of loudspeakers arranged at different positions in a listening space, which method may have the steps of generating a test signal for a loudspeaker; receiving a plurality of different sound signals by a microphone device in response to one or more loudspeaker signals emitted by a loudspeaker of the plurality of loudspeakers in response to the test signal; controlling emissions of the loudspeaker signals by the plurality of loudspeakers and handling the plurality of different sound signals so that a set of sound signals recorded by the microphone device is associated with each loudspeaker of the plurality of loudspeakers in response to the test signal; and evaluating the set of sound signals for each loudspeaker to determine at least one loudspeaker characteristic for each loudspeaker and indicating a loudspeaker state using the at least one loudspeaker characteristic for the loudspeaker.

According to another embodiment, a microphone array may have: three pairs of microphones; and a mechanical support for supporting each pair of microphones at one spatial axis of three orthogonal spatial axes, the three spatial axes has two horizontal axes and one vertical axis.

The present invention is based on the finding that the efficiency and the accuracy of listening tests can be highly improved by adapting the verification of the functionality of the loudspeakers arranged in the listening space using an electric apparatus. This apparatus comprises a test signal generator for generating a test signal for the loudspeakers, a microphone device for picking up a plurality of individual microphone signals, a controller for controlling emissions of the loudspeaker signals and the handling of the sound signal recorded by the microphone device, so that a set of sound signals recorded by the microphone device is associated with each loudspeaker, and an evaluator for evaluating the set of sound signals for each loudspeaker to determine at least one loudspeaker characteristic for each loudspeaker and for indicating a loudspeaker state using the at least one loudspeaker characteristic.

The invention is advantageous in that it allows to perform the verification of loudspeakers positioned in a listening space by an untrained person, since the evaluator will indicate an OK/non-OK state and the untrained person can individually examine the non-OK loudspeaker and can rely on the loudspeakers, which have been indicated to be in a functional state.

Additionally, the invention provides great flexibility in that individually selected loudspeaker characteristics and, advantageously, several loudspeaker characteristics can be used and calculated in addition, so that a complete picture of the loudspeaker state for the individual loudspeakers can be gathered. This is done by providing a test signal to each loudspeaker, advantageously in a sequential way and by recording the loudspeaker signal advantageously using a microphone array. Hence, the direction of arrival of the signal can be calculated, so that the position of the loudspeaker in the room, even when the loudspeakers are arranged in a three-dimensional scheme, can be calculated in an automatic way. Specifically, the latter feature cannot be fulfilled even by an experienced person typically in view of the high accuracy, which is provided by an advantageous inventive system.

In an advantageous embodiment, a multi-loudspeaker test system can accurately determine the position within a tolerance of ±3° for the elevation angle and the azimuth angle. The distance accuracy is ±4 cm and the magnitude response of each loudspeaker can be recorded in an accuracy of ±1 dB of each individual loudspeaker in the listening room. Advantageously, the system compares each measurement to a reference and can so identify the loudspeakers, which are operating outside the tolerance.

Additionally, due to reasonable measurement times, which are as low as 10 s per loudspeaker including processing, the inventive system is applicable in practice even when a large number of loudspeakers have to be measured. In addition, the orientation of the loudspeakers is not limited to any certain configuration, but the measurement concept is applicable for each and every loudspeaker arrangement in an arbitrary three-dimensional scheme.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
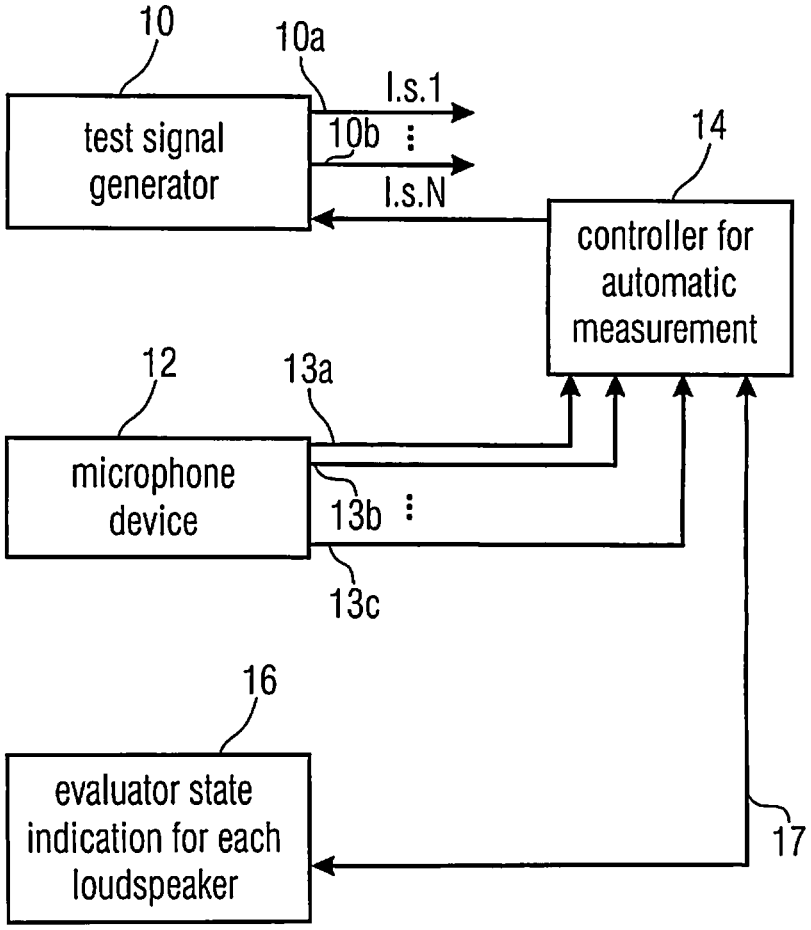
FIG. 1 illustrates a block diagram of an apparatus for measuring a plurality of loudspeakers.
Figure 2:
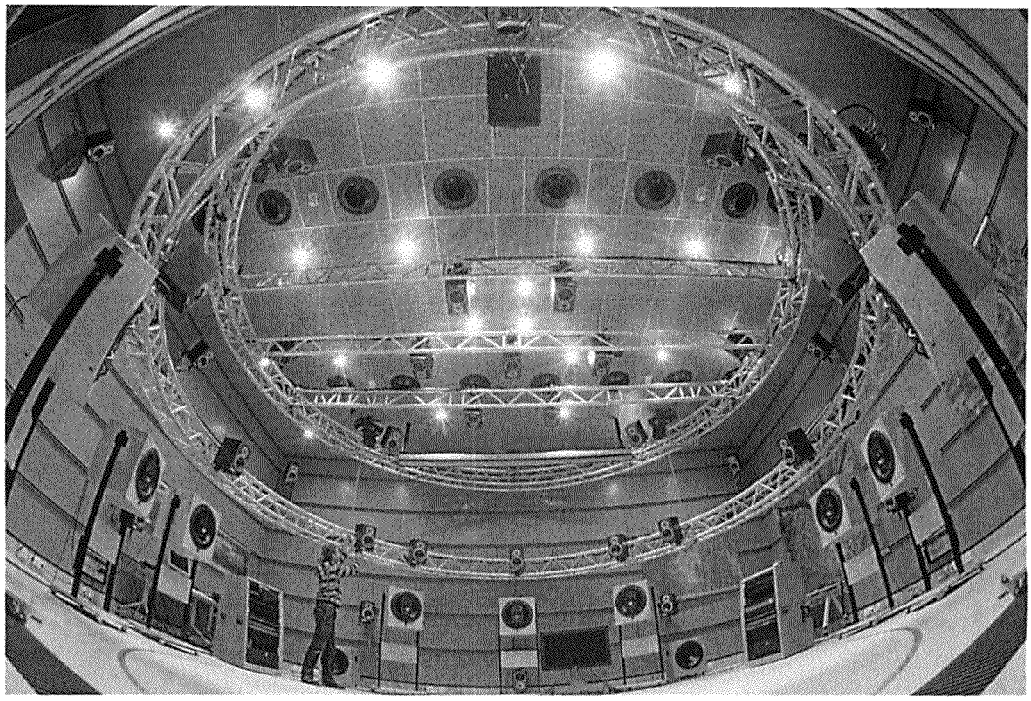
FIG. 2 illustrates an exemplary listening test room with a set-up of 9 main loudspeakers, 2 sub woofers and 43 loudspeakers on the walls and the two circular trusses on different heights.

FIG. 1 illustrates an apparatus for measuring a plurality of loudspeakers arranged at different positions in a listening space. The apparatus comprises a test signal generator 10 for generating a test signal for a loudspeaker. Exemplarily, N loudspeakers are connected to the test signal generator at loudspeaker outputs 10*a*, . . . , 10*b*.

The apparatus additionally comprises a microphone device 12. The microphone device 12 may be implemented as a microphone array having a plurality of individual microphones, or may be implemented as a microphone, which can be sequentially moved between different positions, where a sequential response by the loudspeaker to sequentially applied test signals is measured. for the microphone device is configured for receiving sound signals in response to one or more loudspeaker signals emitted by a loudspeaker of the plurality of loudspeakers in response to one or more test signals.

Additionally, a controller 14 is provided for controlling emissions of the loudspeaker signals by the plurality of loudspeakers and for handling the sound signals received by the microphone device so that a set of sound signals recorded by the microphone device is associated with each loudspeaker of the plurality of loudspeakers in response to one or more test signals. The controller 14 is connected to the microphone device via signal lines 13*a*, 13*b*, 13*c*. When the microphone device only has a single microphone movable to different positions in a sequential way, a single line 13*a* would be sufficient.

The apparatus for measuring additionally comprises an evaluator 16 for evaluating the set of sound signals for each loudspeaker to determine at least one loudspeaker characteristic for each loudspeaker and for indicating a loudspeaker state using the at least one loudspeaker characteristic. The evaluator is connected to the controller via a connection line 17, which can be a single direction connection from the controller to the evaluator, or which can be a two-way connection when the evaluator is implemented to provide information to the controller. Thus, the evaluator provides a state indication for each loudspeaker, i.e. whether this loudspeaker is a functional loudspeaker or is a defective loudspeaker.

Advantageously, the controller 14 is configured for performing an automatic measurement in which a certain sequence is applied for each loudspeaker. Specifically, the controller controls the test signal generator to output a test signal. At the same time, the controller records signals picked up the microphone device and the circuits connected to the microphone device, when a measurement cycle is started. When the measurement of the loudspeaker test signal is completed, the sound signals received by each of the microphones are then handled by the controller and are e.g. stored by the controller in association with the specific loudspeaker, which has emitted the test signal or, more accurately, which was the device under test. As stated before, it is to be verified whether the specific loudspeaker, which has received the test signal is, in fact, the actual loudspeaker, which finally has emitted a sound signal corresponding to the test signal. This is verified by calculating the distance or direction of arrival of the sound emitted by the loudspeaker in response to the test signal advantageously using the directional microphone array.

Alternatively, the controller can perform a measurement of several or all loudspeakers concurrently. To this end, the test signal generator is configured for generating different test signals for different loudspeakers. Advantageously, the test signals are at least partly mutually orthogonal to each other. This orthogonality can include different non-overlapping frequency bands in a frequency multiplex or different codes in a code multiplex or other such implementations. The evaluator is configured for separating the different test signals for the different loudspeakers such as by associating a certain frequency band to a certain loudspeaker or a certain code to a certain loudspeaker in analogy to the sequential implementation, in which a certain time slot is associated to a certain loudspeaker.

Thus, the controller automatically controls the test signal generator and handles the signals picked up by the microphone device to generate the test signals e.g. in a sequential manner and to receive the sound signals in a sequential manner so that the set of sound signals is associated with the specific loudspeaker, which has emitted the loudspeaker test signal immediately before a reception of the set of sound signals by the microphone array.

Figure 5:
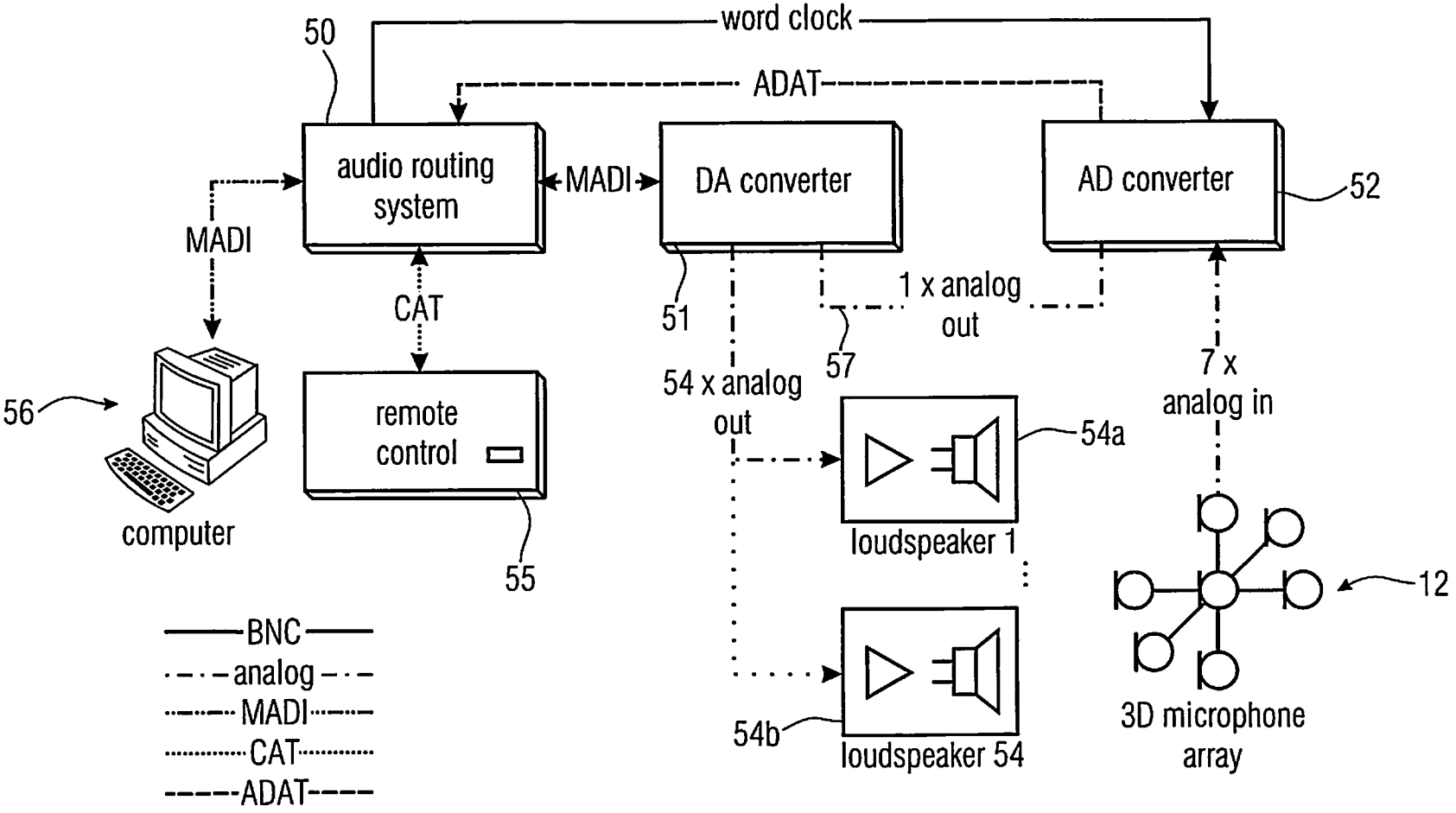
FIG. 5 illustrates a schematic of a hardware set of loudspeakers and microphones.

A schematic of the complete system including the audio routing system, loudspeakers, digital/analog converter, analog/digital converters and the three-dimensional microphone array is presented in FIG. 5. Specifically, FIG. 5 illustrates an audio routing system 50, a digital/analog converter for digital/analog converting a test signal input into a loudspeaker where the digital/analog converter is indicated at 51. Additionally, an analog/digital converter 52 is provided, which is connected to analog outputs of individual microphones arranged at the three-dimensional microphone array 12. Individual loudspeakers are indicated at 54*a*, . . . , 54*b*. The system may comprise a remote control 55 which has the functionality for controlling the audio routing system 50 and a connected computer 56 for the measurement system. The individual connections in the advantageous embodiment are indicated at FIG. 5 where "MADI" stands for multi-channel audio/digital interface, and "ADAT" stands for Alesis-digital-audio-tape (optical cable format). The other abbreviations are known to those skilled in the art. A test signal generator 10, the controller 14 and the evaluator 16 of FIG. 1 are advantageously included in the computer 56 of FIG. 5 or can also be included in the remote control processor 55 in FIG. 5.

Figure 7:
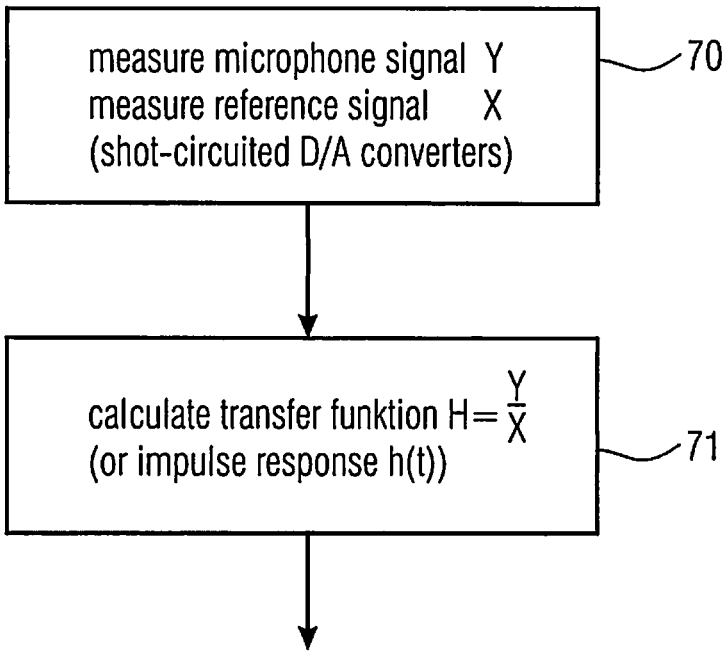
FIG. 7 illustrates an advantageous implementation for determining several loudspeaker characteristics.

Advantageously, the measurement concept is performed on the computer, which is normally feeding the loudspeakers and controls. Therefore, the complete electrical and acoustical signal processing chain from the computer over the audio routing system, the loudspeakers until the microphone device at the listening position is measured. This is advantageous in order to capture all possible errors, which can occur in such a signal processing chain. The single connection 57 from the digital/analog converter 51 to the analog/digital converter 52 is used to measure the acoustical delay between the loudspeakers and the microphone device and can be used for providing the reference signal X illustrated at FIG. 7 to the evaluator 16 of FIG. 1, so that a transfer function or, alternatively, an impulse response from a selected loudspeaker to each microphone can be calculated by convolution as known in the art. Specifically, FIG. 7 illustrates a step 70 performed by the apparatus illustrated in FIG. 1 in which the microphone signal Y is measured, and the reference signal X is measured, which is done by using the short-circuit connection 57 in FIG. 5. Subsequently, in the step 71, a transfer function H can be calculated in the frequency domain by division of frequency-domain values or an impulse response h(t) can be calculated in the time domain using convolution. The transfer function H(f) is already a loudspeaker characteristic, but other loudspeaker characteristics as exemplarily illustrated in FIG. 7 can be calculated as well. These other characteristics are, for example, the time domain impulse response h(t), which can be calculated by performing an inverse FFT of the transfer function. Alternatively, the amplitude response, which is the magnitude of the complex transfer function, can be calculated as well. Additionally, the phase as a function of frequency can be calculated or the group delay T, which is the first derivation of the phase with respect to frequency. A different loudspeaker characteristic is the energy time curve, etc., which indicates the energy distribution of the impulse response. An additional important characteristic is the distance between the loudspeaker and a microphone and a direction of arrival of the sound signal at the microphone is an additional important loudspeaker characteristic, which is calculated using the DirAC algorithm, as will be discussed later on.

The FIG. 1 system presents an automatic multi-loudspeaker test system, which, by measuring each loudspeaker's position and magnitude response, verifies the occurrence of the above-described variety of problems. All these errors are detectable by post-processing steps carried out by the evaluator 16 of FIG. 1. To this end, it is advantageous that the evaluator calculates room impulse responses from the microphone signals which have been recorded with each individual pressure microphone from the three-dimensional microphone array illustrated in FIG. 3.

Advantageously, a single logarithmic sine sweep is used as a test signal, where this test signal is individually played by each speaker under test. This logarithmic sine sweep is generated by the test signal generator 10 of FIG. 1 and is advantageously equal for each allowed speaker. The use of this single test signal to check for all errors is particularly advantageous as it significantly reduces the total test time to about 10 s per loudspeaker including processing.

Advantageously, impulse response measurements are formed as discussed in the context of FIG. 7 where a logarithmic sine sweep is used as the test signal is optimal in practical acoustic measurements with respect to good signal-to-noise ratio, also for low frequencies, not too much energy in the high frequencies (no tweeter damaging signal), a good crest factor and a non-critical behavior regarding small non-linearities.

Alternatively, maximum length sequences (MLS) could also be used, but the logarithmic sine sweep is advantageous due to the crest factor and the behavior against non-linearities. Additionally, a large amount of energy in the high frequencies might damage the loudspeakers, which is also an advantage for the logarithmic since sweep, since this signal has less energy in the high frequencies.

Figures 4A, 4B, 4C:
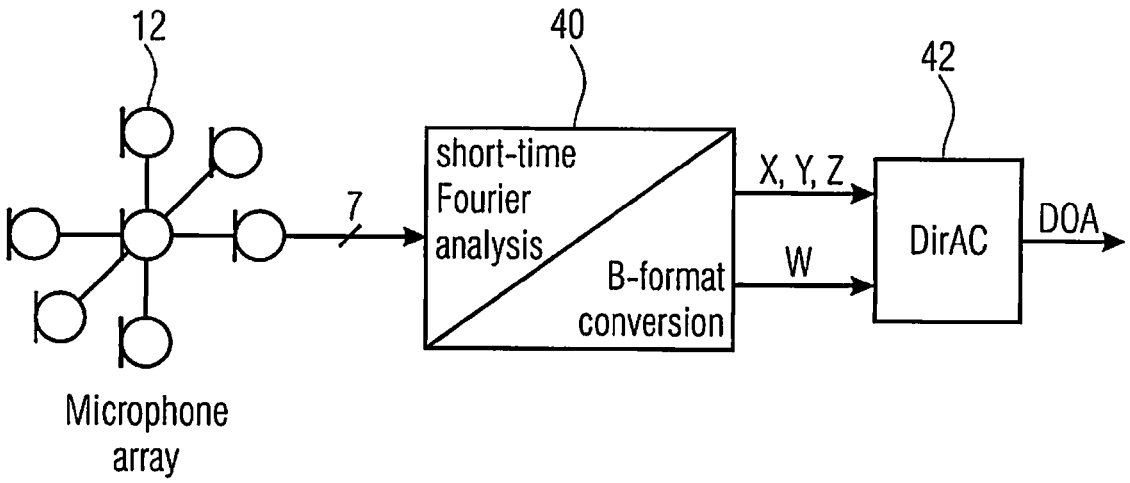
FIG. 4*a* illustrates a schematic for illustrating steps for determining the direction of arrival of the sound using the DirAC procedure.
FIG. 4*b* illustrates equations for calculating particle velocity signals in different directions using microphones from the microphone array in FIG. 3.
FIG. 4*c* illustrates a calculation of an omnidirectional sound signal for a B-format, which is performed when the central microphone is not present.

FIGS. 4*a* to 4*e* will subsequently be discussed to show an advantageous implementation of the direction of arrival estimation, although other direction of arrival algorithms apart from DirAC can be used as well. FIG. 4*a* schematically illustrates the microphone array 12 having 7 microphones, a processing block 40 and a DirAC block 42. Specifically, block 40 performs short-time Fourier analysis of each microphone signal and, subsequently, performs the conversion of these advantageously 7 microphone signals into the B-format having an omnidirectional signal W and having three individual particle velocity signals X, Y, Z for the three spatial directions X, Y, Z, which are orthogonal to each other.

Directional audio coding is an efficient technique to capture and reproduce spatial sound on the basis of a downmix signal and side information, i.e. direction of arrival (DOA) and diffuseness of the sound field. DirAC operates in the discrete short-time Fourier transform (STFT) domain, which provides a time-variant spectral representation of the signals. FIG. 4*a* illustrates the main steps for obtaining the DOA with DirAC analysis. Generally, DirAC may use B-format signals as input, which consists of sound pressure and particle velocity vector measured in one point in space. It is possible from this information to compute the active intensity vector. This vector describes direction and magnitude of the net flow of energy characterizing the sound field in the measurement position. The DOA of a sound is derived from the intensity vector by taking the opposite to its direction and it is expressed, for example, by azimuth and elevation in a standard spherical coordinate system. Naturally, other coordinate systems can be applied as well. The B-format signal that may be used is obtained using a three-dimensional microphone array consisting of 7 microphones illustrated in FIG. 3. The pressure signal for the DirAC processing is captured by the central microphone R7 in FIG. 3, whereas the components of the particle velocity vector are estimated from the pressure difference between opposite sensors along the three Cartesian axes. Specifically, FIG. 4*b* illustrates the equations for calculating the sound velocity vector U(k,n) having the three components $U_x$, $U_y$ and $U_z$.

Figure 3:
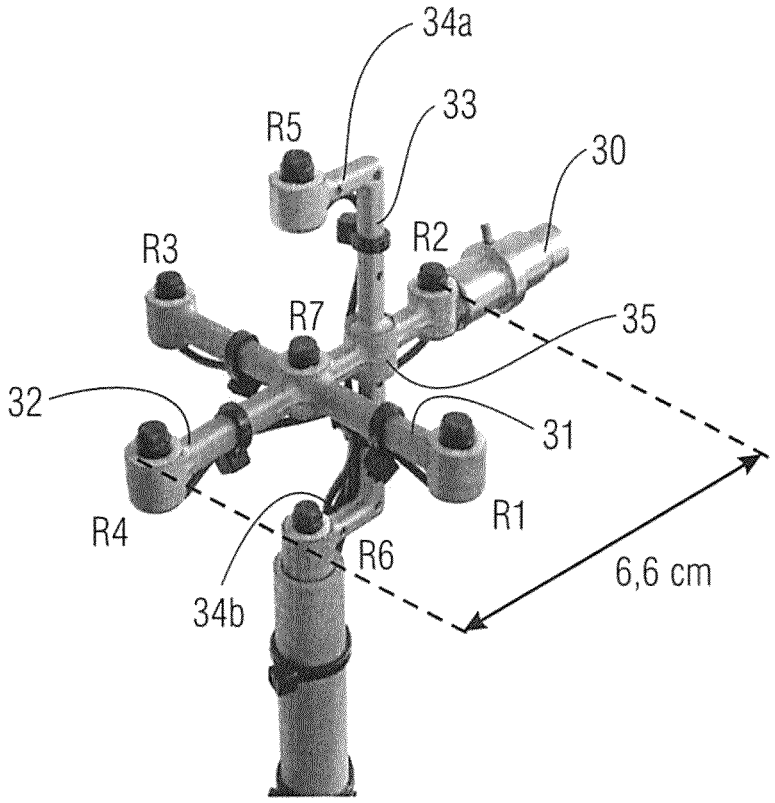
FIG. 3 illustrates an advantageous embodiment of a three-dimensional microphone array.

Exemplarily, the variable $P_1$ stands for the pressure signal of microphone R1 of FIG. 3 and, for example, $P_3$ stands for the pressure signal of microphone R3 in FIG. 3. Analogously, the other indices in FIG. 4*b* correspond to the corresponding numbers in FIG. 3. k denotes a frequency index and n denotes a time block index. All quantities are measured in the same point in space. The particle velocity vector is measured along two or more dimensions. For the sound pressure P(k,n) of the B-format signal, the output of the center microphone R7 is used. Alternatively, if no center microphone is available, P(k, n) can be estimated by combining the outputs of the available sensors, as illustrated in FIG. 4*c*. It is to be noted that the same equations also hold for the two-dimensional and one-dimensional case. In these cases, the velocity components in FIG. 4*b* are only calculated for the considered dimensions. It is to be further noted that the B-format signal can be computed in time domain in exactly the same way. In this case, all frequency domain signals are substituted by the corresponding time-domain signals. Another possibility to determine a B-format signal with microphone arrays is to use directional sensors to obtain the particle velocity components. In fact, each particle velocity component can be measured directly with a bi-directional microphone (a so-called figure-of-eight microphone). In this case, each pair of opposite sensors in FIG. 3 is replaced by a bi-directional sensor pointing along the considered axis. The outputs of the bi-directional sensors correspond directly to the desired velocity components.

Figure 4D:
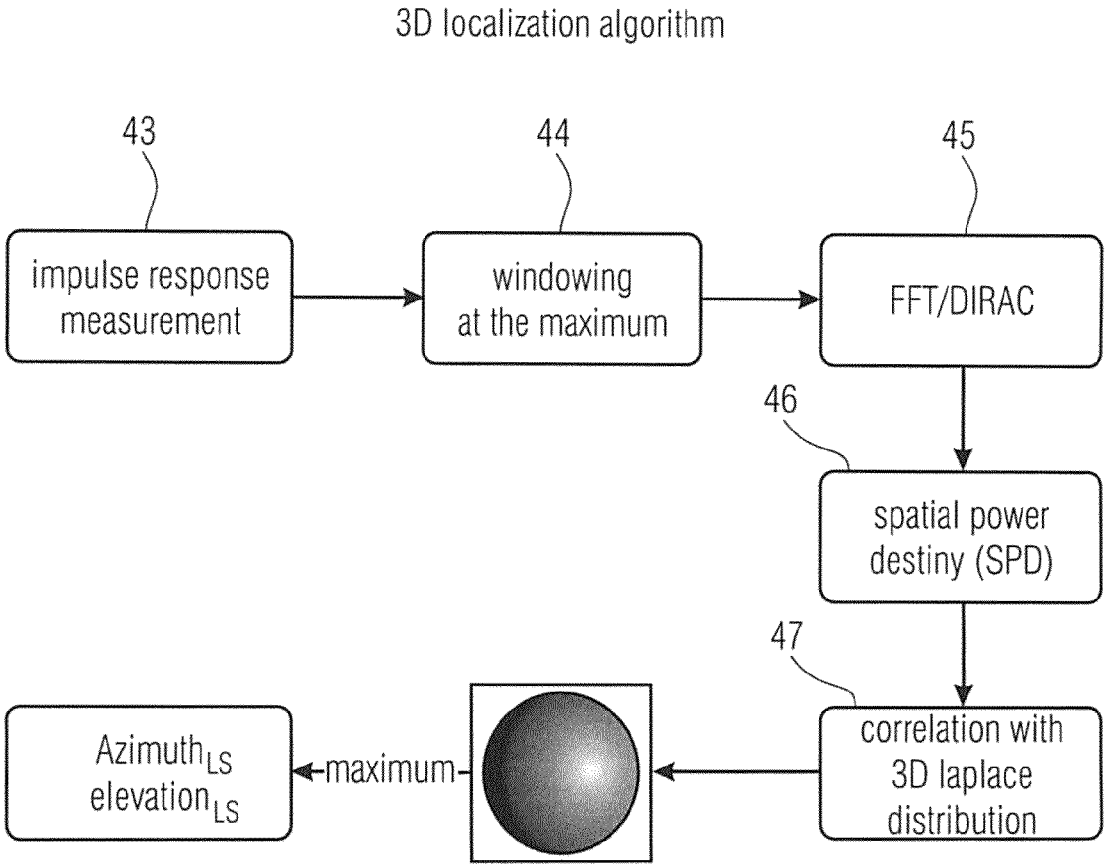
FIG. 4*d* illustrates steps for performing a three-dimensional localization algorithm.
Figure 8:
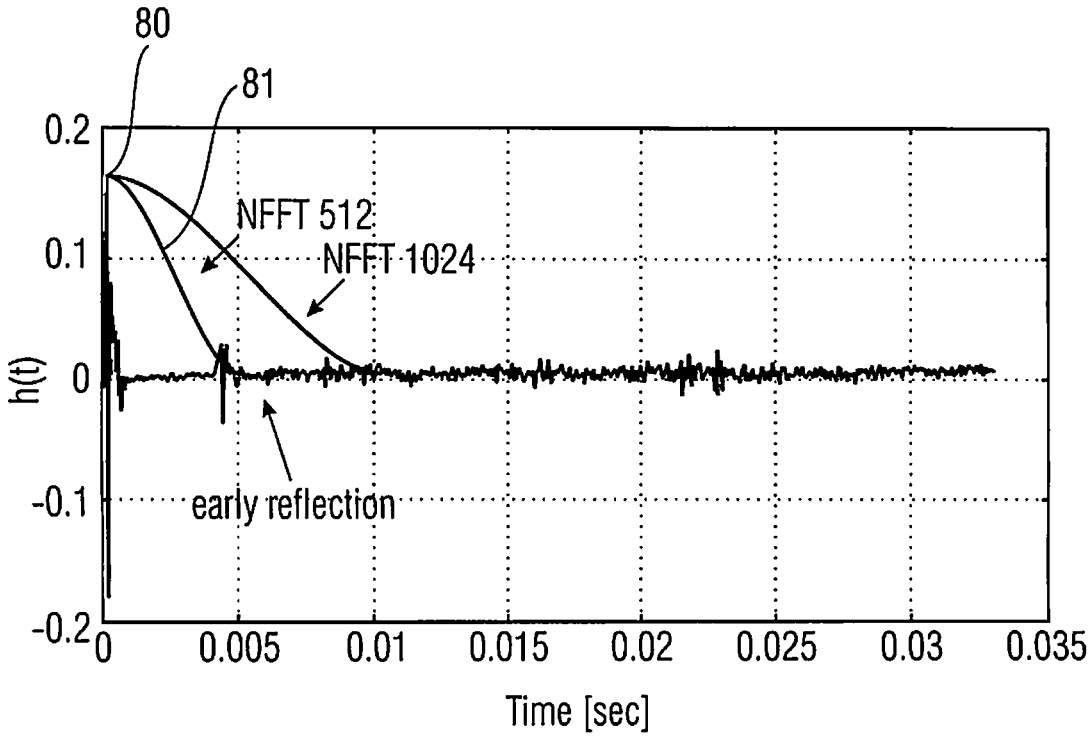
FIG. 8 illustrates an exemplary pulse response and a window length for performing the direction of arrival determination.

FIG. 4*d* illustrates a sequence of steps for performing the DOA in the form of azimuth on the one hand and elevation on the other hand. In a first step, an impulse response measurement for calculating impulse responses for each of the microphones is performed in step 43. A windowing at the maximum of each impulse response is then performed, as exemplarily illustrated in FIG. 8 where the maximum is indicated at 80. The windowed samples are then transformed into a frequency domain at block 45 in FIG. 4*d*. In the frequency domain, the DirAC algorithm is performed for calculating the DOA in each frequency bin of, for example, 20 frequency bins or even more frequency bins. Advantageously, only a short window length of, for example, only 512 samples is performed, as illustrated at an FFT 512 in FIG. 8 so that only the direct sound at maximum 80 until the early reflections, but advantageously excluding the early reflections, is used. This procedure provides a good DOA result, since only sound from an individual position without any reverberations is used.

As indicated at 46, the so-called spatial power density (SPD) is then calculated, which expresses, for each determined DOA, the measured sound energy.

Figure 4E:
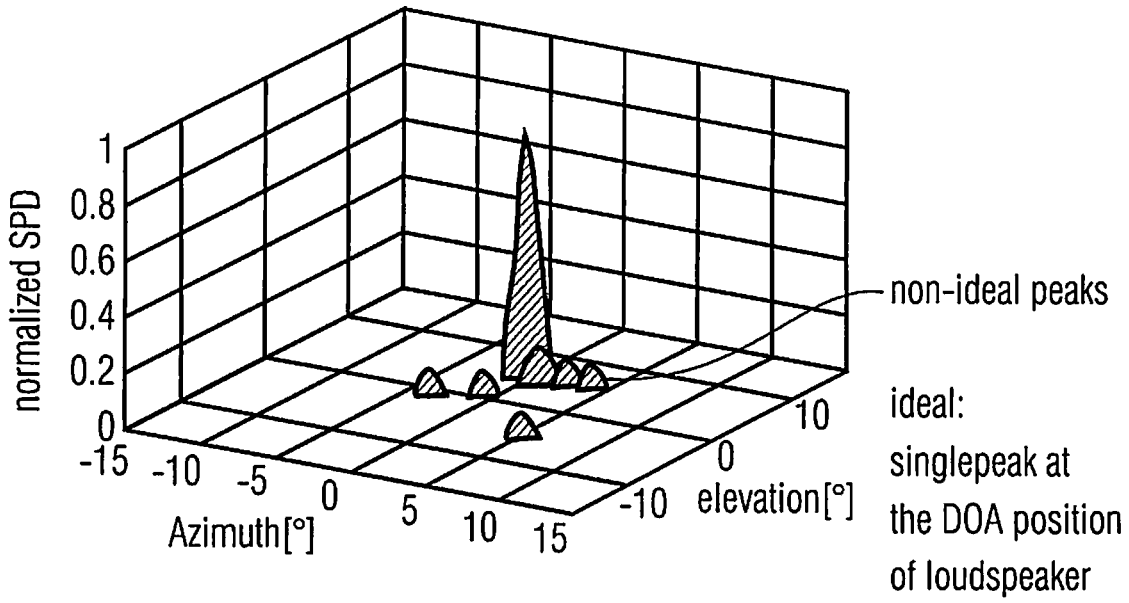
FIG. 4*e* illustrates a real spatial power density for a loudspeaker.

FIG. 4*e* illustrates a measured SPD for a loudspeaker position with elevation and azimuth equal to 0°. The SPD shows that most of the measured energy is concentrated around angles, which correspond to the loudspeaker position. In ideal scenarios, i.e. where no microphone noise is present, it would be sufficient to determine the maximum of the SPD in order to obtain the loudspeaker position. However, in a practical application, the maximum of the SPD does not necessarily correspond to the correct loudspeaker position due to measurement inaccuracies. Therefore, it is simulated, for each DOA, a theoretical SPD assuming zero mean white Gaussian microphone noise. By comparing the theoretical SPDs with the measured SPD (exemplarily illustrated in FIG. 4*e*), the best fitting theoretical SPD is determined whose corresponding DOA then represents the most likely loudspeaker position.

Advantageously, in a non-reverberant environment, the SPD is calculated by the downmix audio signal power for the time/frequency bins having a certain azimuth/elevation. When this procedure is performed in the reverberating environment or when early reflections are used as well, the long-term spatial power density is calculated from the downmix audio signal power for the time/frequency bins, for which a diffuseness obtained by the DirAC algorithm is below a specific threshold. This procedure is described in detail in AES convention paper 7853, Oct. 9, 2009 "Localization of Sound Sources in Reverberant Environments based on Directional Audio Coding Parameters", O. Thiergart, et al.

FIG. 3 illustrates a microphone array having three pairs of microphones. The first pair are microphones R1 and R3 in a first horizontal axis. The second pair of microphones consists of microphones R2 and R4 in a second horizontal axis. The third pair of microphones consists of microphones R5 and R6 representing the vertical axis, which is orthogonal to the two orthogonal horizontal axes.

Additionally, the microphone array consists of a mechanical support for supporting each pair of microphones at one corresponding spatial axis of the three orthogonal spatial axes. In addition, the microphone array comprises a laser 30 for registration of the microphone array in the listening space, the laser being fixedly connected to the mechanical support so that a laser ray is parallel or coincident with one of the horizontal axes.

The microphone array advantageously additionally comprises a seventh microphone R7 placed at a position in which the three axes intersect each other. As illustrated in FIG. 3, the mechanical support comprises the first mechanical axis 31 and the second horizontal axis 32 and a third vertical axis 33. The third horizontal axis 33 is placed in the center with respect to a "virtual" vertical axis formed by a connection between microphone R5 and microphone R6. The third mechanical axis 33 is fixed to an upper horizontal rod 34*a* and a lower horizontal rod 34*b* where the rods are parallel to the horizontal axes 31 and 32. Advantageously, the third axis 33 is fixed to one of the horizontal axes and, particularly, fixed to the horizontal axis 32 at the connection point 35. The connection point 35 is placed between the reception for the seventh microphone R7 and a neighboring microphone, such as microphone R2 of one pair of the three pairs of microphones. Advantageously, the distance between the microphones of each pair of microphones is between 4 cm and 10 cm or even more advantageously between 5 cm and 8 cm and, most advantageously, at 6.6 cm. This distance can be equal for each of the three pairs, but this is not a necessary condition. Rather small microphones R1 to R7 are used and thin mounting may be used for ensuring acoustical transparency. To provide reproducibility of the results, precise positioning of the single microphones and of the whole array may be used. The latter requirement is fulfilled by employing the fixed cross-laser pointer 30, whereas the former requirement is achieved with a stable mounting. To obtain accurate room impulse response measurements, microphones characterized by a flat magnitude response are advantageous. Moreover, the magnitude responses of different microphones should be matched and should not change significantly in time to provide reproducibility of the results. The microphones deployed in the array are high quality omnidirectional microphones DPA 4060. Such a microphone has an equivalent noise level A-weighted of typically 26 dBA re. 20 μPa and a dynamic range of 97 dB. The frequency range between 20 Hz and 20 kHz is in between 2 dB from the nominal curve. The mounting is realized in brass, which ensures the useful mechanical stiffness and, at the same time, the absence of scattering. The usage of omnidirectional pressure microphones in the array in FIG. 3 compared to bi-directional figure-of-eight microphones is advantageousin that individual omnidirectional microphones are considerably cheaper compared to expensive by-directional microphones.

Figure 6A:
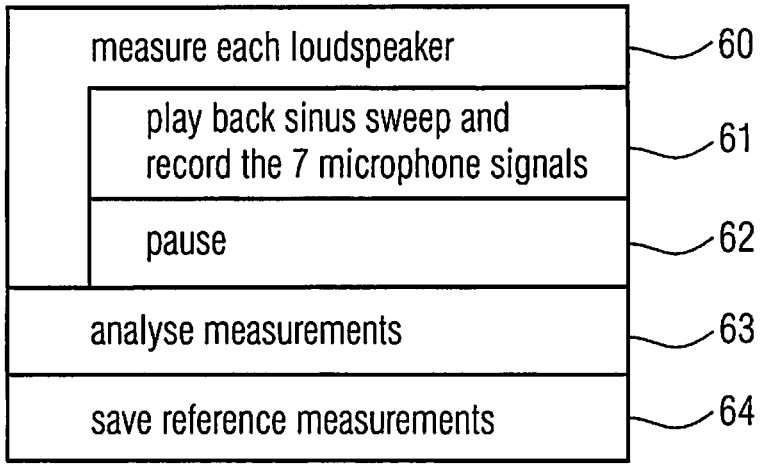
FIG. 6*a* illustrates a measurement sequence for reference.
Figure 6B:
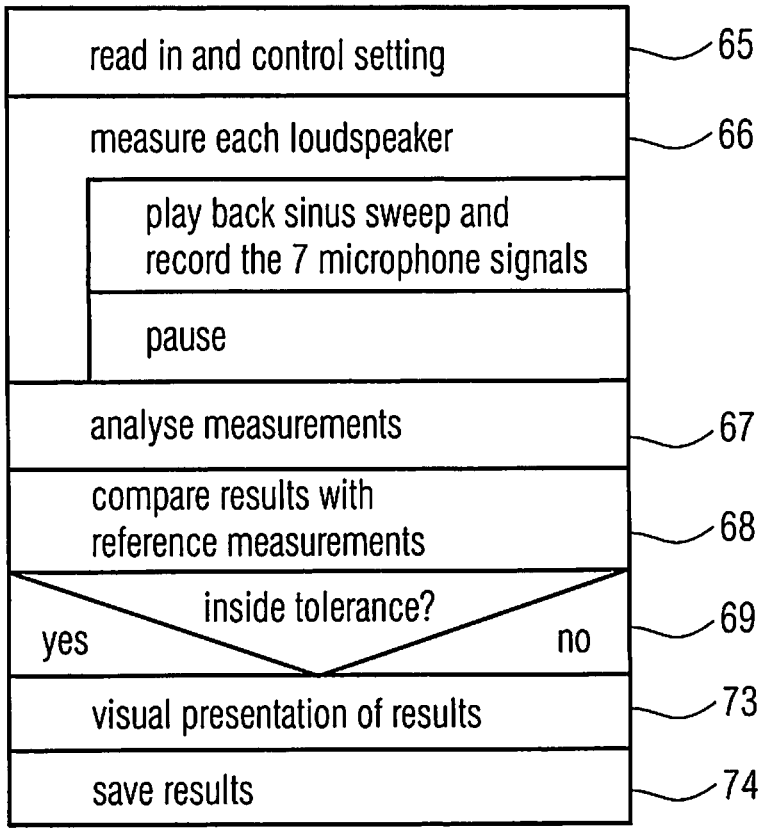
FIG. 6*b* illustrates a measurement sequence for testing.

The measurement system is particularly indicated to detect changes in the system with respect to a reference condition. Therefore, a reference measurement is first carried out, as illustrated in FIG. 6*a*. The procedure in FIG. 6*a* and in FIG. 6*b* is performed by the controller 14 illustrated in FIG. 1. FIG. 6*a* illustrates a measurement for each loudspeaker at 60 where the sinus sweep is played back and the seven microphone signals are recorded at 61. A pause 62 is then conducted and, subsequently, the measurements are analyzed 63 and saved 64. The reference measurements are performed subsequent to a manual verification in that, for the reference measurements, all loudspeakers are correctly adjusted and at the correct position. These reference measurements may be performed only a single time and can be used again and again.

The test measurements should, advantageously, be performed before each listening test. The complete sequence of test measurements is presented in FIG. 6*b*. In a step 65, control settings are read. Next, in step 66, each loudspeaker is measured by playing back the sinus sweep and by recording the seven microphone signals and the subsequent pause. After that, in step 67, a measurement analysis is performed and in step 68, the results are compared with the reference measurement. Next, in step 69, it is determined whether the measured results are inside the tolerance range or not. In a step 73, a visional presentation of results can be performed and in step 74, the results can be saved.

Figure 6C:
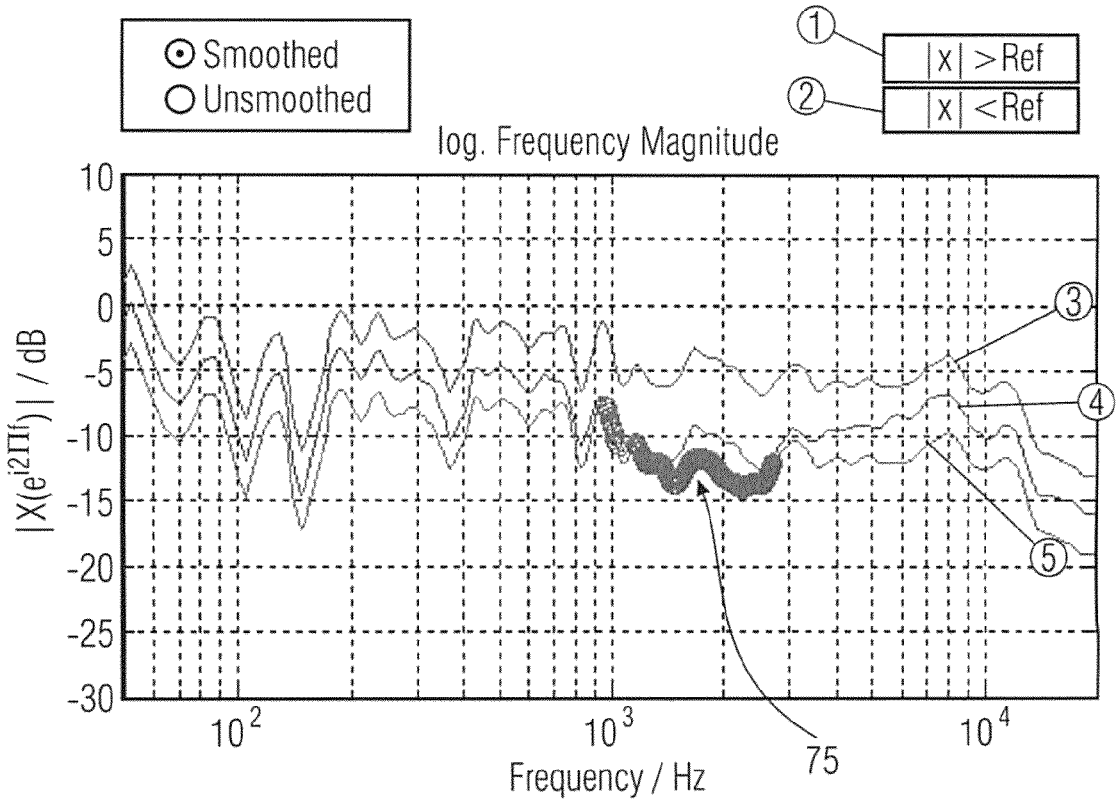
FIG. 6*c* illustrates an exemplary measurement output in the form of a magnitude response where, in a certain frequency range, the tolerances are not fulfilled.

FIG. 6*c* illustrates an example for visual presentation of the results in accordance with step 73 of FIG. 6*b*. The tolerance check is realized by setting an upper and lower limit around the reference measurement. The limits are defined as parameters at the beginning of the measurement. FIG. 6*c* visualizes the measurement output regarding the magnitude response. Curve 3 is the upper limit of the reference measurement and curve 5 is the lower limit. Curve 4 is the current measurement. In this example, a discrepancy in the midrange frequency is shown, which is visualized in the graphical user interface (GUI) by red markers at 75. This violation of the lower limit is also shown in field 2. In a similar fashion, the results for azimuth, elevation, distance and polarity are presented in the graphical user interface.

Figure 9:
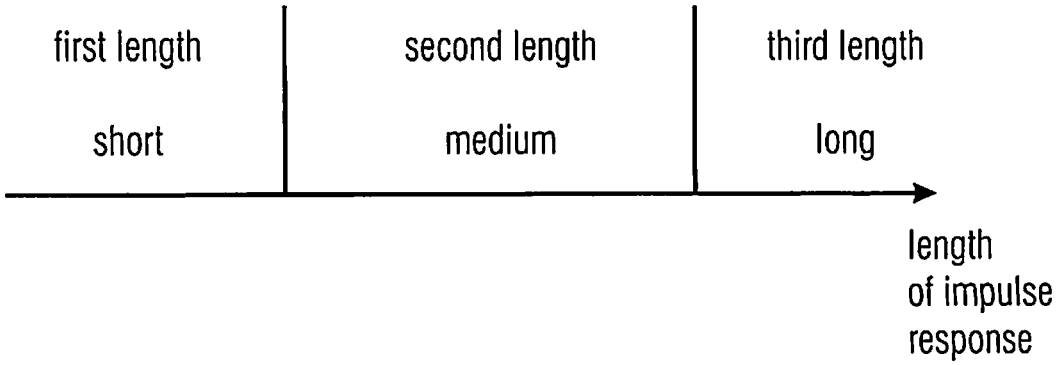
FIG. 9 illustrates the relations of the lengths of portions of impulse response(s) which may be used for measuring the distance, the direction of arrival and the impulse response/transfer function of a loudspeaker.

FIG. 9 will subsequently be described in order to illustrate the three advantageous main loudspeaker characteristics, which are calculated for each loudspeaker in the measuring of a plurality of loudspeakers. The first loudspeaker characteristic is the distance. The distance is calculated using the microphone signal generated by microphone R7. To this end, the controller 14 of FIG. 1 controls the measurement of the reference signal X and the microphone signal Y of the center microphone R7. Next, the transfer function of the microphone signal R7 is calculated, as outlined in step 71. In this calculation, a search for the maximum, such as 80 in FIG. 8 of the impulse response calculated in step 71 is performed. Afterwards, this time at which the maximum 80 occurs is multiplied by the sound velocity v in order to obtain the distance between the corresponding loudspeaker and the microphone array.

To this end, only a short portion of the impulse response obtained from the signal of microphone R7 may be used, which is indicated as a "first length" in FIG. 9. This first length only extends from 0 to the time of the maximum 80 and including this maximum, but not including any early reflections or diffuse reverberations. Alternatively, any other synchronization can be performed between the test signal and the response from the microphone, but using a first small portion of the impulse response calculated from the microphone signal of microphone R7 is advantageous due to efficiency and accuracy.

Next, for the DOA measurements, the impulse responses for all seven microphones are calculated, but only a second length of the impulse response, which is longer than the first length, is used and this second length advantageously extends only up to the early reflections and, advantageously, do not include the early reflections. Alternatively, the early reflections are included in the second length in an attenuated state determined by a side portion of a window function, as e.g. illustrated in FIG. 8 by window shape 81. The side portion has window coefficients smaller than 0.5 or even smaller than 0.3 compared to window coefficients in the mid portion of the window, which approach 1.0. The impulse responses for the individual microphones R1 to R7 are advantageously calculated, as indicated by steps 70, 71.

Advantageously a window is applied to each impulse response or a microphone signal different from the impulse response, wherein a center of the window or a point of the window within 50 percents of the window length centered around the center of the window is placed at the maximum in each impulse response or a time in the microphone signal corresponding to the maximum to obtain a windowed frame for each sound signal The third characteristic for each loudspeaker is calculated using the microphone signal of microphone R5, since this microphone is not influenced too much by the mechanical support of the microphone array illustrated in FIG. 3. The third length of the impulse response is longer than the second length and, advantageously, includes not only the early reflections, but also the diffuse reflections and may extend over a considerable amount of time, such as 0.2 ms in order to have all reflections in the listening space. Naturally, when the room is a quite non-reverberant room, then the impulse response of microphone R5 will be close to 0 quite earlier. In any case, however, it is advantageous to use a short length of the impulse response for a distance measurement, to use the medium second length for the DOA measurements and to use a long length for measuring the loudspeaker impulse response/transfer function, as illustrated at the bottom of FIG. 9.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

ITU-R Recommendation-BS. 1116-1, "Methods for the subjective assessment of small impairments in audio systems including multichannel sound systems", 1997, Intern. Telecom Union: Geneva, Switzerland, p. 26.

A. Silzle et al., "Vision and Technique behind the New Studios and Listening Rooms of the Fraunhofer IIS Audio Laboratory", presented at the AES 126$^{th}$ convention, Munich, Germany, 2009.

S. Müller, and P. Massarani, "Transfer-Function Measurement with Sweeps", J. Audio Eng. Soc., vol. 49 (2001 June).

Messtechnik der Akustik, ed. M. Mser. 2010, Berlin, Heidelberg: Springer.

V. Pulkki, "Spatial sound reproduction with directional audio coding", Journal of the AES, vol. 55, no. 6, pp. 503-516, 2007.

O. Thiergart, R. Schultz-Amling, G. Del Galdo, D. Mahne, and F. Kuech, "Localization of Sound Sources in Reverberant Environments Based on Directional Audio Coding Parameters", presented at the AES 127$^{th}$ convention, New York, N.Y., USA, 2009 October 9-12.

J. Merimaa, T. Lokki, T. Peltonen and M. Karjalainen, "Measurement, Analysis, and Visualization of Directional Room Responses," presented at the AES 111$^{th}$ convention, New York, N.Y., USA, 2001 September 21-24.

G. Del Galdo, O. Thiergart, and F. Keuch, "Nested microphone array processing for parameter estimation in directional audio coding", in Proc. IEEE Workshop on Applications of Signal Processing to Audio and Acoustics (WASPAA), New Paltz, N.Y., October 2009, accepted for publication.

F. J. Fahy, Sound Intensity, Essex: Elselvier Science Publishers Ltd., 1989.

A. Silzle and M. Leistner, "Room Acoustic Properties of the New Listening-Test Room of the Fraunhofer IIS," presented at the AES 126 convention, Munich, Germany, 2009.

ST350 Portable Microphone System, User Manual. "http://www.soundfield.com/".

J. Ahonen, V. Pulkki, T. Lokki, "Teleconference Application and B-Format Microphone Array for Directional Audio Coding", presented at the AES 30$^{th}$ International Conference: Intelligent Audio Environments, March 2007.

M. Kallinger, F. Kuech, R. Schultz-Amling, G. Del Galdo, J. Ahonen and V. Pulkki, "Analysis and adjustment of planar microphone arrays for application in Directional Audio Coding", presented at the AES 124th convention, Amsterdam, The Netherlands, 2008 May 17-20.

H. Balzert, Lehrbuch der Software-Technik (Software-Entwicklung), 1996, Heidelberg, Berlin, Oxford: Spektrum Akademischer Verlag.

"http://en.wikipedia.org/wiki/Nassi%E2%80%93 Shneiderman . . . diagram", accessed on March, 31, 2010.

R. Schultz-Amling, F. Kuech, M. Kallinger, G. Del Galdo, J. Ahonen, and V. Pulkki, "Planar Microphone Array Processing for the Analysis and Reproduction of Spatial Audio using Directional Audio Coding", presented at the 124th AES Convention, Amsterdam, The Netherlands, May 2008.

The invention claimed is:

1. An apparatus for measuring a plurality of loudspeakers arranged at different positions, comprising:

a test signal generator for generating a test signal for a loudspeaker;

a microphone device being configured for receiving a plurality of different sound signals in response to loudspeaker signals emitted by loudspeakers of the plurality of loudspeakers in response to the test signal;

a controller for controlling emissions of the loudspeaker signals by the plurality of loudspeakers and for handling the plurality of different sound signals so that a set of sound signals recorded by the microphone device is associated with each loudspeaker of the plurality of loudspeakers in response to the test signal; and an evaluator for evaluating the set of sound signals for each loudspeaker to determine at least one loudspeaker characteristic for each loudspeaker and for indicating a loudspeaker state using the at least one loudspeaker characteristic for the loudspeaker, wherein the microphone device comprises a microphone array comprising three pairs of microphones arranged on three spatial axes;

wherein an omnidirectional pressure signal is derived by the evaluator by using the signals received by the three pairs or using a further microphone arranged at a point in which the three spatial axes intersect each other, wherein the evaluator is configured for calculating a distance between the microphone array and a loudspeaker using the omnidirectional pressure signal, wherein the omnidirectional pressure signal comprises a first length in samples, the first length extending to a maximum of the omnidirectional pressure signal;

calculating an impulse response or transfer function of the loudspeaker using a microphone signal from an individual microphone of the three pairs, the microphone signal comprising a third length in samples, the third length comprising at least a direct sound maximum and early reflections, the third length being longer than the first length; and calculating a direction of arrival of the sound from the loudspeaker using signals from all microphones, the signals comprising a second length in samples being longer than the first length and shorter than the third length, the second length comprising values up to an early reflection so that the early reflections are not comprised by the second length or are comprised by the second length in an attenuated state determined by a side portion of a window function.

2. The apparatus in accordance with claim 1, in which the controller is configured for automatically controlling the test signal generator and the microphone device to generate the test signals in a sequential manner and to receive the sound signals in a sequential manner so that the set of sound signals is associated with the specific loudspeaker, which has emitted the loudspeaker test signal immediately before a reception of the set of sound signals, or in which the controller is configured for automatically controlling the test signal generator and the microphone device to generate the test signals in a parallel manner and to demultiplex the sound signals so that the set of sound signals is associated with the specific loudspeaker, which is associated to a certain frequency band of the set of sound signals or which is associated to a certain code sequence in a code multiplexed test signal.

3. The apparatus in accordance with claim 1, in which the evaluator is configured for calculating a distance between the loudspeaker position for a loudspeaker and the microphone device by using a time delay value of a maximum of an impulse response of a sound signal between the loudspeaker and the microphone device and by using the sound velocity in air.

4. The apparatus in accordance with claim 1, in which the controller is configured for performing a reference measurement using the test signal in which an analog output of a digital/analog converter to a loudspeaker and an analog input of an analog/digital converter to which the microphone device are connected is directly connected to determine reference measurement data; and in which the evaluator is configured to determine a transfer function or an impulse response for a selected microphone of the plurality of microphones using the reference measurement data to determine an impulse response or a transfer function for the loudspeaker as the loudspeaker characteristic.

5. The apparatus according to claim 1, in which the evaluator is configured for calculating a direction of arrival for sound emitted by a loudspeaker using the set of sound signals, wherein the evaluator is adapted for transforming the set of test signals into B-format signals comprising an omnidirectional signal and at least two particle velocity signals for at least two orthogonal directions in space;

calculating, for each frequency bin of a plurality of frequency bins, a direction of arrival result; and determining the direction of arrival for the sound emitted by the loudspeaker using the direction of arrival results for the plurality of frequency bins.

6. The apparatus in accordance with claim 5, in which the evaluator is configured for calculating an impulse response for each microphone, for searching a maximum in each impulse response;

for applying a window to each impulse response or a microphone signal different from the impulse response, wherein a center of the window or a point of the window within 50 percents of the window length centered around the center of the window is placed at the maximum in each impulse response or a time in the microphone signal corresponding to the maximum to achieve a windowed frame for each sound signal; and for converting each frame from the time domain to a spectral domain.

7. The apparatus in accordance with claim 5, in which the evaluator is configured for determining the direction of arrival by calculating a real spatial power density comprising a value for each elevation angle and for each azimuth angle, and for providing a plurality of ideal spatial power densities assuming zero mean white Gaussian microphone noise for different elevation angles and azimuth angles, and selecting the elevation angle and azimuth angle belonging to the ideal spatial power density, which comprises a best fit to the real spatial power density.

8. The apparatus according to claim 1, in which the microphone device comprises a microphone array comprising three pairs of microphones arranged on three spatial axes;

wherein an omnidirectional pressure signal is derived by the evaluator by using the signals received by the three pairs or using a further microphone arranged at a point in which the three spatial axes intersect each other.

9. The apparatus in accordance with claim 1, in which the evaluator is configured for comparing the at least one loudspeaker characteristic to an expected loudspeaker characteristic and to indicate a loudspeaker comprising the at least one loudspeaker characteristic equal to the expected loudspeaker characteristic as a functional loudspeaker and to indicate a loudspeaker not comprising the at least one loudspeaker characteristic equal to the expected loudspeaker characteristic as a non-functional loudspeaker.

10. A method of measuring a plurality of loudspeakers arranged at different positions in a listening space, comprising:

generating a test signal for a loudspeaker;

receiving a plurality of different sound signals by a microphone device in response to loudspeaker signals emitted by loudspeakers of the plurality of loudspeakers in response to the test signal;

controlling emissions of the loudspeaker signals by the plurality of loudspeakers and handling the plurality of different sound signals so that a set of sound signals recorded by the microphone device is associated with each loudspeaker of the plurality of loudspeakers in response to the test signal; and evaluating the set of sound signals for each loudspeaker to determine at least one loudspeaker characteristic for each loudspeaker and indicating a loudspeaker state using the at least one loudspeaker characteristic for the loudspeaker, wherein the microphone device comprises a microphone array comprising three pairs of microphones arranged on three spatial axes;

wherein an omnidirectional pressure signal is derived by the evaluating by using the signals received by the three pairs or using a further microphone arranged at a point in which the three spatial axes intersect each other, wherein the evaluating comprises:

calculating a distance between the microphone array and a loudspeaker using the omnidirectional pressure signal, wherein the omnidirectional pressure signal comprises a first length in samples, the first length extending to a maximum of the omnidirectional pressure signal;

calculating an impulse response or transfer function of the loudspeaker using a microphone signal from an individual microphone of the three pairs, the microphone signal comprising a third length in samples, the third length comprising at least a direct sound maximum and early reflections, the third length being longer than the first length; and calculating a direction of arrival of the sound from the loudspeaker using signals from all microphones, the signals comprising a second length in samples being longer than the first length and shorter than the third length, the second length comprising values up to an early reflection so that the early reflections are not comprised by the second length or are comprised by the second length in an attenuated state determined by a side portion of a window function.

11. A non-transitory storage medium having stored thereon a computer program for performing, when running on a processor, a computer program implementing the method of measuring a plurality of loudspeakers arranged at different positions in a listening space, said method comprising:

generating a test signal for a loudspeaker;

receiving a plurality of different sound signals by a microphone device in response to loudspeaker signals emitted by loudspeakers of the plurality of loudspeakers in response to the test signal;

controlling emissions of the loudspeaker signals by the plurality of loudspeakers and handling the plurality of different sound signals so that a set of sound signals recorded by the microphone device is associated with each loudspeaker of the plurality of loudspeakers in response to the test signal; and evaluating the set of sound signals for each loudspeaker to determine at least one loudspeaker characteristic for each loudspeaker and indicating a loudspeaker state using the at least one loudspeaker characteristic for the loudspeaker, wherein the microphone device comprises a microphone array comprising three pairs of microphones arranged on three spatial axes;

wherein an omnidirectional pressure signal is derived by the evaluating by using the signals received by the three pairs or using a further microphone arranged at a point in which the three spatial axes intersect each other, wherein the evaluating comprises:

calculating a distance between the microphone array and a loudspeaker using the omnidirectional pressure signal, wherein the omnidirectional pressure signal comprises a first length in samples, the first length extending to a maximum of the omnidirectional pressure signal;

calculating an impulse response or transfer function of the loudspeaker using a microphone signal from an individual microphone of the three pairs, the microphone signal comprising a third length in samples, the third length comprising at least a direct sound maximum and early reflections, the third length being longer than the first length; and calculating a direction of arrival of the sound from the loudspeaker using signals from all microphones, the signals comprising a second length in samples being longer than the first length and shorter than the third length, the second length comprising values up to an early reflection so that the early reflections are not comprised by the second length or are comprised by the second length in an attenuated state determined by a side portion of a window function.

12. An apparatus for measuring a plurality of loudspeakers arranged at different positions, comprising:

a test signal generator for generating a test signal for a loudspeaker;

a microphone device being configured for receiving a plurality of different sound signals in response to loudspeaker signals emitted by loudspeaker of the plurality of loudspeakers in response to the test signal;

a controller for controlling emissions of the loudspeaker signals by the plurality of loudspeakers and for handling the plurality of different sound signals so that a set of sound signals recorded by the microphone device is associated with each loudspeaker of the plurality of loudspeakers in response to the test signal; and an evaluator for evaluating the set of sound signals for each loudspeaker to determine at least one loudspeaker characteristic for each loudspeaker and for indicating a loudspeaker state using the at least one loudspeaker characteristic for the loudspeaker, wherein the evaluator is configured for calculating a direction of arrival for sound emitted by a loudspeaker using the set of sound signals, wherein the evaluator is adapted for transforming the set of test signals into B-format signals comprising an omnidirectional signal and at least two particle velocity signals for at least two orthogonal directions in space;

calculating, for each frequency bin of a plurality of frequency bins, a direction of arrival result; and determining the direction of arrival for the sound emitted by the loudspeaker using the direction of arrival results for the plurality of frequency bins;

wherein the determining the direction of arrival comprises determining the direction of arrival by calculating a real spatial power density comprising a value for each elevation angle and for each azimuth angle, and providing a plurality of ideal spatial power densities assuming zero mean white Gaussian microphone noise for different elevation angles and azimuth angles, and selecting the elevation angle and azimuth angle belonging to the ideal spatial power density, which comprises a best fit to the real spatial power density.

13. A method of measuring a plurality of loudspeakers arranged at different positions in a listening space, comprising:

generating a test signal for a loudspeaker;

receiving a plurality of different sound signals by a microphone device in response to loudspeaker signals emitted by loudspeakers of the plurality of loudspeakers in response to the test signal;

controlling emissions of the loudspeaker signals by the plurality of loudspeakers and handling the plurality of different sound signals so that a set of sound signals recorded by the microphone device is associated with each loudspeaker of the plurality of loudspeakers in response to the test signal; and evaluating the set of sound signals for each loudspeaker to determine at least one loudspeaker characteristic for each loudspeaker and indicating a loudspeaker state using the at least one loudspeaker characteristic for the loudspeaker, wherein the evaluating comprises calculating a direction of arrival for sound emitted by a loudspeaker using the set of sound signals, using:

transforming the set of test signals into B-format signals comprising an omnidirectional signal and at least two particle velocity signals for at least two orthogonal directions in space;

calculating, for each frequency bin of a plurality of frequency bins, a direction of arrival result; and determining the direction of arrival for the sound emitted by the loudspeaker using the direction of arrival results for the plurality of frequency bins;

wherein the determining the direction of arrival comprises determining the direction of arrival by calculating a real spatial power density comprising a value for each elevation angle and for each azimuth angle, and providing a plurality of ideal spatial power densities assuming zero mean white Gaussian microphone noise for different elevation angles and azimuth angles, and selecting the elevation angle and azimuth angle belonging to the ideal spatial power density, which comprises a best fit to the real spatial power density.

14. A non-transitory storage medium having stored thereon a computer program for performing, when running on a processor, a computer program implementing the method of measuring a plurality of loudspeakers arranged at different positions in a listening space, said method comprising:

generating a test signal for a loudspeaker;

receiving a plurality of different sound signals by a microphone device in response to loudspeaker signals emitted by loudspeakers of the plurality of loudspeakers in response to the test signal;

controlling emissions of the loudspeaker signals by the plurality of loudspeakers and handling the plurality of different sound signals so that a set of sound signals recorded by the microphone device is associated with each loudspeaker of the plurality of loudspeakers in response to the test signal; and evaluating the set of sound signals for each loudspeaker to determine at least one loudspeaker characteristic for each loudspeaker and indicating a loudspeaker state using the at least one loudspeaker characteristic for the loudspeaker, wherein the evaluating comprises calculating a direction of arrival for sound emitted by a loudspeaker using the set of sound signals, using:

transforming the set of test signals into B-format signals comprising an omnidirectional signal and at least two particle velocity signals for at least two orthogonal directions in space;

calculating, for each frequency bin of a plurality of frequency bins, a direction of arrival result; and determining the direction of arrival for the sound emitted by the loudspeaker using the direction of arrival results for the plurality of frequency bins;

wherein the determining the direction of arrival comprises determining the direction of arrival by calculating a real spatial power density comprising a value for each elevation angle and for each azimuth angle, and providing a plurality of ideal spatial power densities assuming zero mean white Gaussian microphone noise for different elevation angles and azimuth angles, and selecting the elevation angle and azimuth angle belonging to the ideal spatial power density, which comprises a best fit to the real spatial power density.

* * * * *